United States Patent [19]

Cross et al.

[11] 4,240,637

[45] Dec. 23, 1980

[54] PUTTING PRACTICE APPARATUS

[76] Inventors: Robert Cross, 89 Wybunbury Rd., Wistaston, Nantwich, Cheshire; Terrence R. Cross, Hillside, Church Minshull, Nantwich, Cheshire; Alvan Cross, Timber Tops, Woodland Hills, Madeley, Near Crewe, Cheshire, all of England

[21] Appl. No.: 953,690

[22] Filed: Oct. 23, 1978

[30] Foreign Application Priority Data

Nov. 9, 1977 [GB] United Kingdom ..... 46590/77

[51] Int. Cl.[3] ..... A63B 69/36; A63B 67/02

[52] U.S. Cl. ..... 273/176 H; 273/179 C

[58] Field of Search ..... 273/176 H, 176 FA, 176 F, 273/DIG. 31

[56] References Cited

U.S. PATENT DOCUMENTS

| | | | |
|---|---|---|---|
| 1,612,291 | 12/1926 | Jackson | 273/176 H |
| 2,334,540 | 11/1943 | Buffham | 273/176 H |
| 2,379,663 | 7/1945 | Smith | 273/176 FA |
| 2,557,550 | 6/1951 | Leaver et al. | 273/176 FA |
| 3,170,694 | 2/1965 | Dolce | 273/176 H X |
| 3,508,756 | 4/1970 | Bedford | 273/176 H |
| 3,601,407 | 8/1971 | Lorrance | 273/176 H |
| 3,735,988 | 5/1973 | Palmer et al. | 273/176 H |
| 3,762,718 | 10/1973 | Culley | 273/176 H |
| 3,870,301 | 3/1975 | Brisendine | 273/176 H X |

*Primary Examiner*—George J. Marlo
*Attorney, Agent, or Firm*—Ross, Ross & Flavin

[57] ABSTRACT

A golf putting apparatus consists of a deck having an upper putting surface which deck is variably adjusted with respect to a base by means of several height adjustment devices, each comprising a bolt turnable by a handle and having a nut threaded thereon, which nut is held captive with respect to the deck so that turning of a respective handle effects a variance of the height of a portion of the deck and of the magnitude of the slope of the deck surface.

1 Claim, 9 Drawing Figures

PUTTING PRACTICE APPARATUS

BACKGROUND TO THE INVENTION

This invention concerns putting practice apparatus which can be used either indoors or outdoors, for practising putting and which can be adjusted so as to vary the nature of the shots which can be practised.

Putting practice apparatus of this type is already known from U.S. Pat. No. 3,762,718 which discloses a device in which the slope of a position of a putting surface in the vicinity of a hole is variable in its orientation. This device has the disadvantage that the magnitude of the slope is not variable and also that there are likely to be irregularities in the putting surface at a transition between a flat portion of that surface and the portion of variable slope. Furthermore, the known apparatus provides only a flat slope and does not provide, or allow the variation of, a curved playing surface.

BRIEF SUMMARY OF THE INVENTION

It is an aim of the present invention to provide putting practice apparatus which overcomes some or all of the aforementioned disadvantages of the prior art.

With this aim in view, the present invention provides putting practice apparatus comprising a base, a putting surface along which a golf ball can be putted towards a hole in the surface, and adjustment means for varying the slope of a portion of the putting surface, characterised in that the putting surface is provided by the upper surface of a deck supported by or mounted within the base, and in that the adjustment means is operative to vary the height of at least one part of the deck thereby varying the curvature or the magnitude of the slope of the deck surface.

The deck conveniently comprises or is supported by a deck panel (e.g. of chipboard, plyboard or the like) having a small degree of inherent deformability to permit its contour(s) to be varied by raising or lowering of at least one region thereof. This panel may be provided with a felt or like covering layer or grass simulating material and may be rectangular in configuration. The base may comprise a frame, preferably of moulded glass reinforced plastics material or injection moulded from a plastics material, and the deck may be supported in said frame by portions of its edges engaging into C-shaped or channel-shaped locators, at least one of these locators being adjustable in its height. This adjustment may be provided for by the or each locator being engaged upon a respective rotatable threaded upright post, a means being provided to permit manual rotation of the or each post to effect the adjustment. Said means may comprise a crank-like handle formed integrally with or attached to the post.

The said locators may be provided two along each longitudinal edge of the deck, these preferably being towards that end of the deck in which the hole is disposed. The outer end of the deck may simply rest down on the base.

The frame forming the base may be such as to provide two upstanding side walls along the two longitudinal edges of the deck and an end wall across one end of the deck adjacent the hole. The adjusting means may conveniently then be mounted upon the side walls.

A cup may be disposed in the hole in the playing surface, said cup having its open end flush with or adjacent and below the playing surface.

Alternatively the hole in the playing surface may communicate with a channel or passageway disposed beneath the deck and preferably sloping towards a collection place at that end of the device remote from the hole such that the holed balls are automatically delivered to the collection place.

At least a part of the periphery of the deck may be adjacent a corresponding gap or space sufficient to allow a ball reaching said part of the periphery to drop off the deck and out of play. Preferably that end and the sides of the deck adjacent and in the region of the hole are spaced from the side wall or walls of the apparatus to provide a gap sufficient for a golf ball to drop out of play.

Means may be provided for collecting balls falling off the periphery of the deck and delivering the balls to the collection place or to a further collection place. Said means may comprise one or a plurality of channels or passageways which slope down to the collection place or to the further collection place.

Means, such as a coin operated mechanism, may be provided for releasing balls collected in the or each collection place into a receptacle to allow the balls to be played again.

DESCRIPTION OF THE PREFERRED EMBODIMENT

Figure 6:
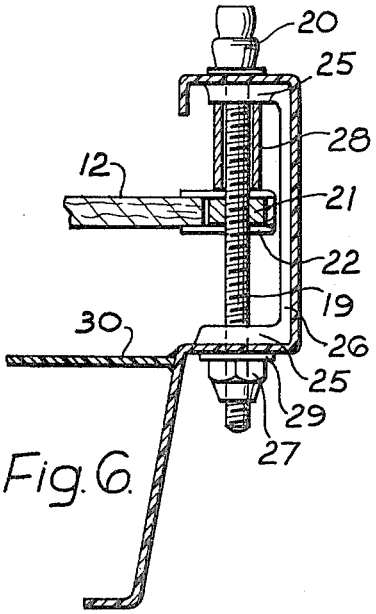
FIG. 6 is a section along line 6—6 in FIG. 3.
Figure 7:
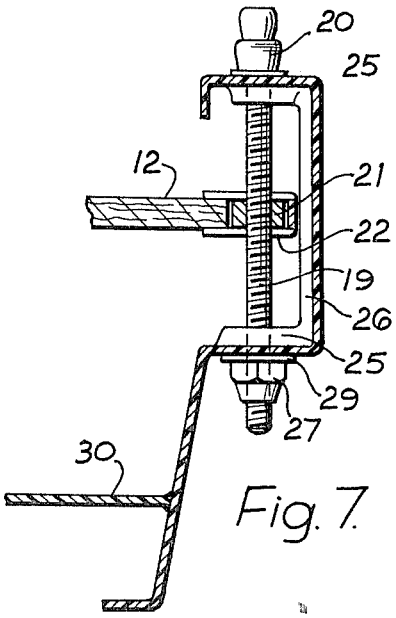
FIG. 7 is a section along line 7—7 in FIG. 3.
Figure 8:
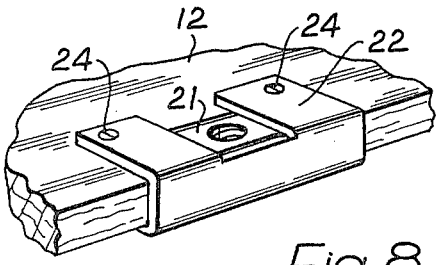
FIG. 8 is a perspective view showing a captive nut and housing of the type shown in FIGS. 6 and 7.
Figure 9:
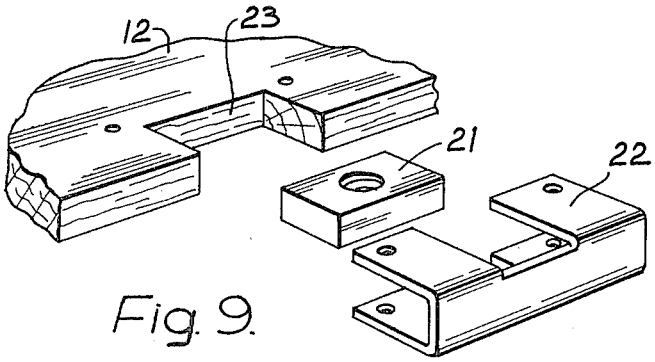
FIG. 9 is an exploded view of the captive nut and housing of FIG. 8.

The apparatus, indicated as a whole by the numeral 10, comprises a frame 11 moulded from glass reinforced plastics material and a deck 12 supported by the frame 11. The deck 12 consists of a rectangular sheet of plywood with its upper surface 13 covered in felt to provide a smooth but soft surface on which to play a golf ball. The deck 12 is supported at its rear end 14 by resting on a rear portion of the frame 11, and is also supported by four height adjustment devices 15, 16, 17 and 18 each of which comprises (FIGS. 6 and 7) a respective one of screw threaded bolts 19 turnable by means of a handle 20 and engage with a captive nut 21 disposed in a housing 22. As may be seen most clearly from FIGS. 8 and 9 the nut 21 is disposed in a cutaway portion 23 of the deck 12 and is held in place by the housing 22 which in turn is fixed to the deck by means of screw threaded bolts 24. Each of the bolts 19 extend through and between the arms 25 of a respective C-shaped reinforcing bracket 26 disposed in a channel defined within the side walls of the frame 11 of the apparatus. A respective stiff nut 27 serves each bolt 19 in position. Both the height adjustment devices 17 and 18 disposed at the front end of the apparatus are provided with a respective metal tube 28 which acts to limit upward movement of the playing surface at that end.

Figure 1:
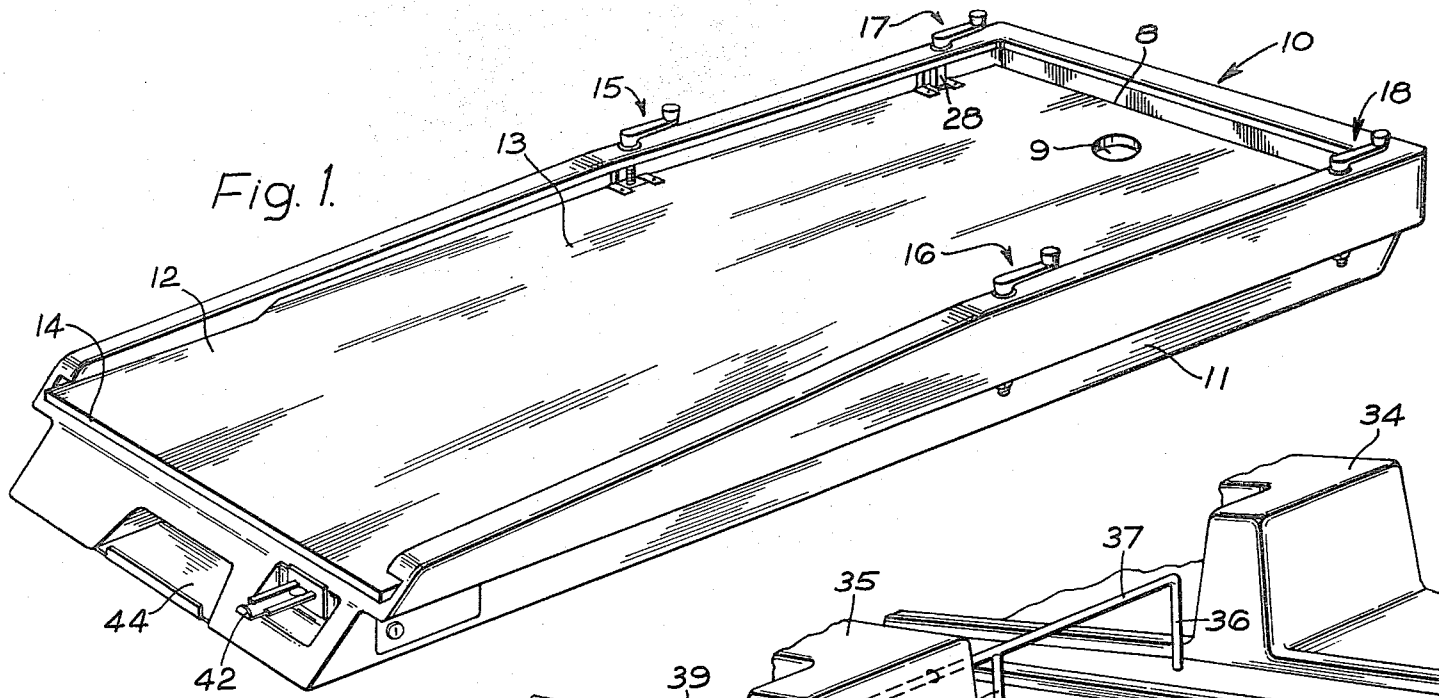
FIG. 1 is a perspective view of putting practice apparatus constructed in accordance with the invention.
Figure 5:
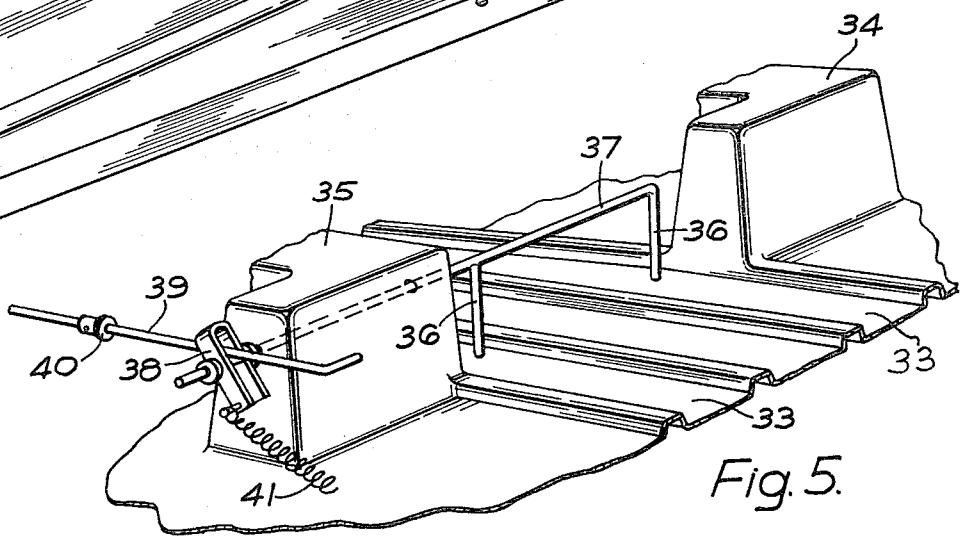
FIG. 5 is a perspective view of a mechanism of the apparatus of FIG. 1 for capturing and releasing golf balls.
Figure 2:
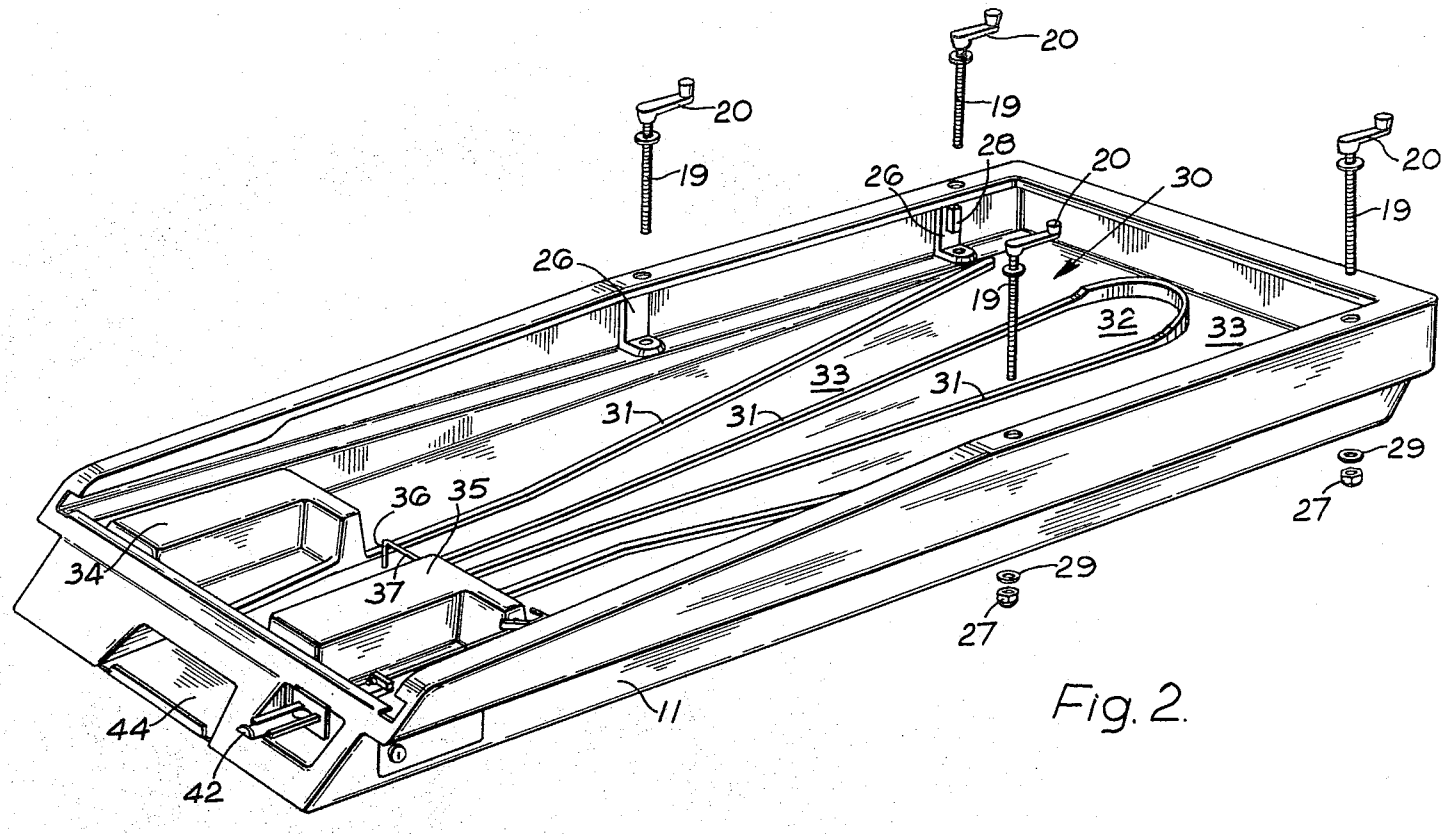
FIG. 2 is a perspective view of the apparatus of FIG. 1 with the deck removed and adjusting means shown in "exploded" form.
Figure 3:
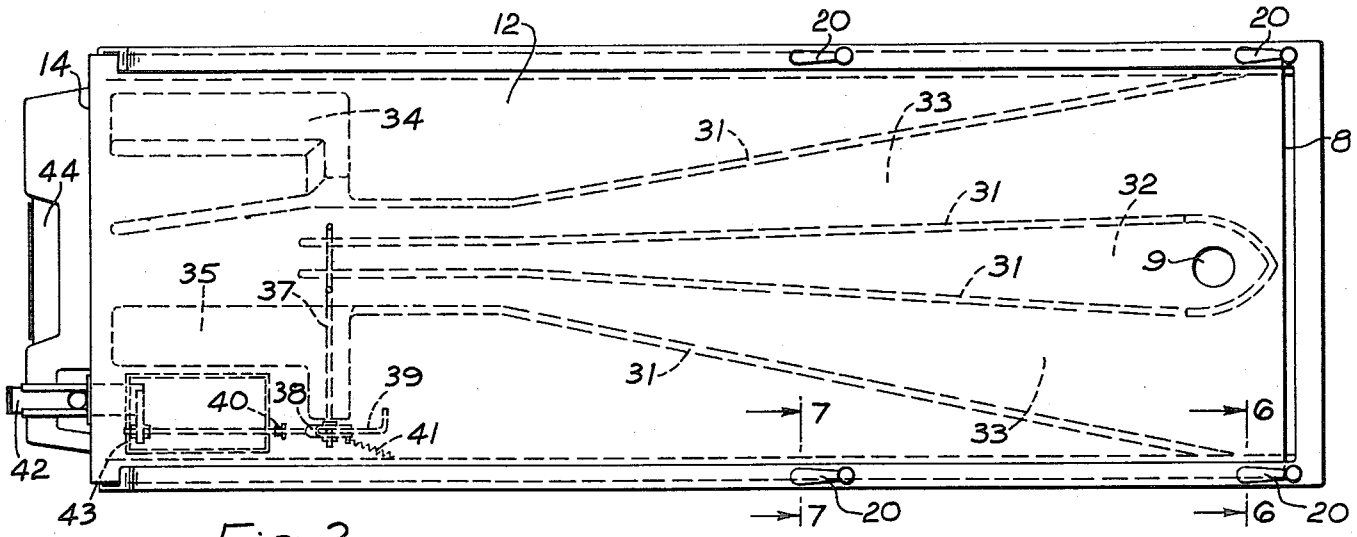
FIG. 3 is a plan view of the apparatus of FIG. 1.
Figure 4:
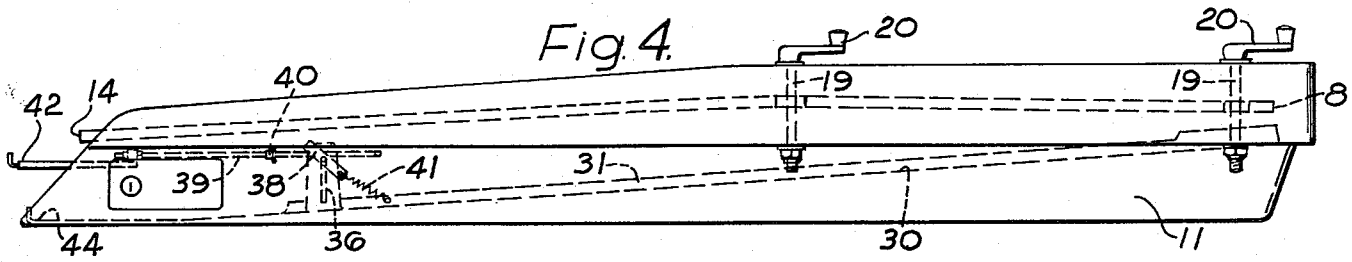
FIG. 4 is a side elevation of the apparatus of FIG. 1.

The front end of the deck 12 is provided with a centrally disposed circular hole 9 which communicates with the interior of the apparatus. As will be seen from FIG. 2 the interior of the frame 11 comprises a floor 30 which is an integral part of the fibreglass moulding and which slopes (FIG. 4) upwardly towards the front of the frame. Elongate raised portions 31 are moulded in the floor 30 and define an inner channel or guided pathway 32 and outer channels 33. All three channels converge to a passageway between raised regions 34 and 35 (FIG. 5) at which point both outer channels 33 are intercepted by respective ones of depending arms 36 of a rod 37 extending through and mounted for axial rotation in raised region 35. The end of rod 37 remote from depending arms 36 has a U-shaped bracket 38 fixed thereon and a rod 39 of a coin operated mechanism extends between the arms of the bracket 38. The rod 39 carries a fixed sleeve 40 which on actuation of the coin operated mechanism pivots bracket 38, and with it rod 37, against the action of a spring 41 attached to one of the arms of bracket 38 and to the frame 11 of the apparatus.

To use the apparatus, a player first inserts the required coin into a slider 42 of the operated mechanism and the slider is pushed in until the coin falls into a coin collection box 42. Movement of the slider simultaneously displaces rod 39 so that sleeve 40 engages and pivots bracket 38 and with it rod 37 with depending arms 36 which replaces balls, held in channels 33, which then roll into receptacle 44. The player then stands on the deck 12 at the rear of the apparatus and with a golf putter strikes balls towards hole 9. The front edge 8 of the deck 12 is spaced from the front wall of the frame 11 by an amount sufficient to allow a golf ball to fall through to the floor 30 of the frame. Thus balls missing hole 9 and passing the hole will fall over edge 8 and roll down one of channels 33 until stopped by arms 36 of rod 37. However, balls which are successfully holed will fall through to channel 32 and be returned to receptacle 44. Increasing skill is thus rewarded by further play.

By turning handles 20 the player is able to vary the height of deck 12 at four different points on its sides thus altering the curvature, slope or tilt of the playing surface of the deck and as a consequence changing the speed and direction which must initially be imparted to the ball if it is to be holed. The tubes 28 limit the height to which the front portion of deck 12 may be raised so that sufficient room is always present for mis-hit balls to reach edge 8 and to fall to the deck 30 below. It will be appreciated that turning one of the handles 20 turns a corresponding bolt 19 and consequently the respective captive bolt and with it the adjoining portion of deck 12 is moved up or down accordingly. The stiff nut 27 turns with the bolt 19 and a corresponding washer 29 serves as a bearing for the nut 27 as it turns.

The apparatus may be sited in any suitable place such as golf clubs, public houses, business establishments and amusement arcades. The only attention required in the periodic emptying of money from the collection box 43. Of course a coin release mechanism is not necessary for all situations and a model suitable, for example, for use in the home might simply provide for the return of all holed balls, and balls falling off the edge of the deck, to the receptacle without any provision for intercepting returning balls or for releasing balls to the receptacle.

The invention is not limited to the aforegoing details and many other embodiments are possible. Thus, for example, the apparatus may incorporate a timing mechanism which limits the period of play to a predetermined extent. In this case actuation of a coin-operated mechanism may, in addition to releasing one or more balls, initiate the predetermined timing period at the end of which balls holed or falling out of play are retained by the apparatus.

We claim:

1. Putting practice apparatus comprising:

a frame, a planar deck supported by the frame and having an apertured upper surface defining a putting surface, a plurality of spaced vertically-extending turnable threaded bolts for varying the height of at least a part of the deck and the magnitude of the slope of the deck upper surface, the deck having a degree of deformability for allowing its contour to be varied by the changing of the height of at least one region thereof, a plurality of spaced C-shaped locator brackets fixed to the frame and supporting a respective one of the bolts extendable therethrough, at least one of the locator brackets being adjustable in height, a cranklike handle attached to each bolt for permitting bolt rotation in the height adjustment function, the deck being provided with a plurality of cutaway portions along the side edges thereof, a captive nut being nestably receivable within each cutaway portion and threaded on the respective bolt extendable therethrough, an encapsulating housing enclosing a respective cutaway portion and holding a respective captive nut in situ within the respective cutaway portion.

* * * * *